United States Patent [19]

Matsumoto

[11] Patent Number: 5,007,851

[45] Date of Patent: Apr. 16, 1991

[54] POWER SOCKET

[75] Inventor: Koji Matsumoto, Yao, Japan

[73] Assignee: Hosiden Corporation, Yao, Japan

[21] Appl. No.: 592,593

[22] Filed: Oct. 4, 1990

[30] Foreign Application Priority Data

Oct. 12, 1989 [JP] Japan ..... 1-119276[U]

[51] Int. Cl.[5] ..... H01R 29/00

[52] U.S. Cl. ..... 439/188; 439/733; 200/51.1

[58] Field of Search ..... 200/51 R, 51.1; 439/79, 439/80, 188, 733, 746, 747

[56] References Cited

U.S. PATENT DOCUMENTS 4,329,008 5/1982 Braginetz ..... 439/80

4,380,691 4/1983 Sato ..... 200/51.1

4,832,614 5/1989 Jenkins ..... 439/188

4,948,376 8/1990 Penning ..... 439/188

*Primary Examiner*—Neil Abrams

*Assistant Examiner*—Khiem Nguyen

*Attorney, Agent, or Firm*—Jones, Tullar & Cooper

[57] ABSTRACT

In the power socket in accordance with the present invention, the pin and the stationary and movable contact pieces are disposed in a direction along the surface of a circuit board on which the power socket is to be mounted, so that the length of the plug connection portion of the pin may be shortened. The power socket according to the present invention requires no cover for fixing the stationary and movable contact pieces. Provision is made such that the portions for engagingly securing the pin and a lateral wall of the housing are reinforced by the pin, the stationary contact piece or the movable contact piece, thereby to reduce the housing in thickness.

21 Claims, 4 Drawing Sheets

POWER SOCKET

BACKGROUND OF THE INVENTION

1. Field of the Invention

The present invention relates to a power socket to be mounted on a radio, a tape recorder, a video camera or the like.

2. Description of the Invention

FIGS. 6 and 7 show a conventional power socket disclosed by Japanese Utility Model Publication No. 60/20308 (Japanese Utility Model Registration No. 1627076).

This power socket includes a hollow housing 100 to be mounted on a circuit board (not shown); a cover 110 mounted on the housing 100; a pin 120 having a plug connection portion 121 and a terminal portion 122 molded in an L-shape; and stationary and movable contact pieces (not shown). In the housing 100, the plug connection portion 121 of the pin 120 and the stationary and movable contact pieces are arranged in the height direction of the housing 100, i.e., the direction B at a right angle to a direction A along the surface of a circuit board (not shown) at the time when the power socket is mounted thereon.

More specifically, the cover 110 is mounted on the housing 100 at the rear end thereof. The cover 110 and a rear wall 101 of the housing 100 respectively have pin insertion holes 111 and 102, in which the plug connection portion 121 of the pin 120 is pressingly inserted. The terminal portion 122 of the pin 120 projects toward the circuit board. The terminal portion 122 is engaged with an L-shape engagement fixing body 130 formed on the cover 110. The housing 100 is provided at the lower portion thereof with an opening 103 adjacent to the rear wall 101. The stationary and movable contact pieces inserted from this opening 103 are disposed in a space 104 communicating with the opening 103. Terminals 141, 142 extending from the contact pieces are guided to the outside of the housing 100 through respective notch-like concave portions 105, 106 formed in the housing 100. These terminals 141, 142 project toward the circuit board. The cover 110 or the projection piece 112 is pushed to these terminals 141, 142. This causes the contact pieces to be fixed to the housing 100.

In the power socket having the arrangement above-mentioned, when a plug (not shown) is inserted in or removed from the plug connection portion 121 of the pin 120, the movable contact piece is displaced by the plug. This causes the movable contact of the movable contact piece to be separated from or come in contact with the stationary contact of the stationary contact piece, so that the contacts are opened or closed.

Recently, an electric machinery such as a radio, a video camera or the like is required to be made in a compact design, yet assuring a variety of functions. It is therefore required to mount, with a considerably high density, a variety of electric or electronic components on a circuit board. In this connection, a power socket is also strongly required to be made in an extremely compact design by minimizing the outer dimensions thereof.

However, it is difficult to reduce the outer dimensions (more specifically, the depth size) of the conventional power socket above-mentioned for the following structural reasons.

As a first reason, the plug connection portion 121 of the pin 120 and the stationary and movable contact pieces are disposed in the housing 100 in the direction B at a right angle to the direction A along the surface of the circuit board. Due to such an arrangement, in order that the terminal portion 122 of the pin 120 projects toward the circuit board it is required that the boundary corner portion a between the plug connection portion 121 and the terminal portion 122 of the pin 120 is positioned rearward (upward in FIGS. 6 and 7) of the rear ends of the stationary and movable contact pieces. Otherwise, the terminal portion 122 of the pin 120 which projects toward the circuit board, comes in contact with the stationary or movable contact piece. That portion of the plug connection portion 121 of the pin 120 which projects inside of the housing 100, has a predetermined length which cannot be shortened without any restriction. Accordingly, to assure a suitable position of the corner portion a, the length of the plug connection portion 121 is inevitably relatively lengthened.

As a second reason, the cover 110 is inevitable as a member for pushing the terminals 141, 142 of stationary and movable contact pieces so that the contact pieces are secured to the housing 100. Accordingly, it is not possible to adopt the arrangement where the engagement fixing body 130 is formed directly on the housing 100 with the cover 110 eliminated. Thus, the entire depth L' of the power socket becomes equal to the total sum of the depth D' of the housing 100, the projection height H' of the engagement fixing body 130 and the thickness T' of the cover 110.

In the conventional power socket having the arrangement above-mentioned, due to the requirements that the length of the plug connection portion 121 of the pin 120 should be lengthened and the cover 110 is inevitable, great restrictions are imposed on the arrangement to shorten the entire depth L' of the power socket to make the same in an extremely compact design.

SUMMARY OF THE INVENTION

In view of the foregoing, the present invention is proposed with the main object of providing a power socket in which, even though the length of the plug connection portion of the pin is shortened, the terminal portion of the pin does not come in contact with the stationary and movable contact piece, and in which the stationary and movable contact pieces are secured to the housing without the use of the cover, so that the power socket may be readily made in an extremely compact design.

It is another object of the present invention to provide a power socket in which, even though the housing is made thinner, the required strength is assured, so that the power socket may be made in a further extremely compact design.

To achieve the objects above-mentioned, a power socket in accordance with an embodiment of the present invention comprises:

a housing;

an opening into and from which a plug is to be inserted and removed, said opening formed at the front end surface of the housing;

a rear wall having a pin insertion hole and formed at that position of the rear end surface of the housing which is opposite to the opening;

a pin having a plug connection portion and a terminal portion molded in an L-shape, the plug connection portion being inserted, through the pin insertion hole, into the hollow portion in the housing, the terminal portion extending along the rear wall and projecting toward a circuit board on which the power socket is to be mounted;

a stationary contact piece having (i) a plate portion having a stationary contact and (ii) a terminal which extends from the plate portion and which projects from the housing toward the circuit board, the stationary contact piece being disposed, with respect to the pin, in a direction along the surface of the circuit board;

a fixing portion formed at the stationary contact piece for securing the stationary contact piece to the housing;

a movable contact piece made of a metallic piece molded substantially in an U-shape, the movable contact piece being provided at one end thereof with movable contacts adapted to be separated from or come in contact with the stationary contact and at the other end thereof with a seat plate portion from which a terminal extends, the terminal projecting from the housing toward the circuit board, the movable contact piece being disposed, with respect to the pin, in the direction above-mentioned along the surface of the circuit board, the movable contact piece being adapted to be displaced by a plug inserted in or removed from the plug connection portion, so that the movable contacts are separated from or come in contact with the stationary contact;

a fixing portion formed at the movable contact piece for securing the movable contact piece to the housing; and an engagement fixing body engaged with the rear portion of the terminal portion of the pin for securing the terminal portion, the engagement fixing body being formed on the rear wall.

According to the power socket having the arrangement above-mentioned, in the inside space of the housing to be mounted on a circuit board, the plug connection portion of the pin and the stationary and movable contact pieces are arranged, side by side, in a direction along the surface of the circuit board. Accordingly, even though the pin terminal projecting toward the circuit board is disposed as overlapping the stationary and movable contact pieces in the direction above-mentioned, the pin terminal does not come in contact with the stationary and movable contact pieces. It is therefore not required to dispose the boundary corner portion between the plug connection portion and the terminal portion of the pin at positions rearward of the stationary and movable contact pieces. Further, the stationary and movable contact pieces are secured, through the respective fixing portions thereof, to the housing. It is therefore not required to dispose, at the rear end of the housing, an independent member such as the cover as used in the conventional power socket.

According to the power socket of the embodiment above-mentioned, the length of the plug connection portion of the pin may be shortened as compared with the conventional power socket and the cover as conventionally required is eliminated. It is therefore possible to provide a power socket in an extremely compact design in which the entire depth is smaller than that of the conventional power socket.

According to a power socket in accordance with another embodiment of the present invention, the engagement fixing body has (i) a support wall rearwardly projecting from the rear wall and (ii) an engagement piece projecting from the support wall in a direction along the surface of the circuit board, and the terminal portion of the pin is held by and between the rear wall and the engagement piece.

With the arrangement above-mentioned, the pin is securely fixed to the housing. Further, the base portion of the plug connection portion of the pin comes in contact with the support wall, so that the support wall is reinforced.

According to a power socket in accordance with a further embodiment of the present invention, a pair of edges of the plate portion of the stationary contact piece are respectively inserted in grooves respectively formed in the bottom and upper walls of the housing, and the plate portion comes in surface contact with the support wall. Accordingly, the support wall is reinforced more securely so that the support wall may be made thin.

According to a power socket in accordance with still another embodiment of the present invention, a pair of edges of the seat plate portion of the movable contact piece are respectively inserted in grooves respectively formed in the bottom and upper walls, and the seat plate portion comes in surface contact with the inner surface of a lateral wall of the housing. With the arrangement above-mentioned, the lateral wall may be reinforced without addition of a special member. Thus, the lateral wall of the housing may be made thin.

Other features and advantages of the present invention will be apparent from the following description of embodiments thereof.

DETAILED DESCRIPTION OF THE PREFERRED EMBODIMENT

Figure 1:
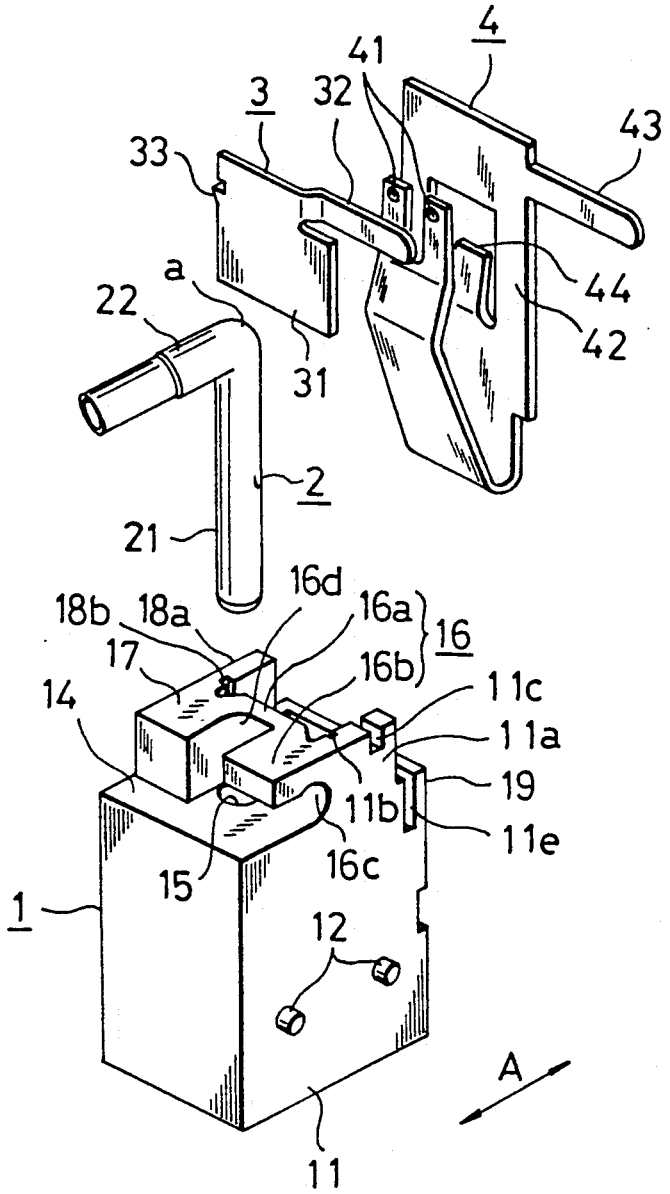
FIG. 1 is an exploded perspective view of a power socket in accordance with an embodiment of the present invention.
Figure 2:
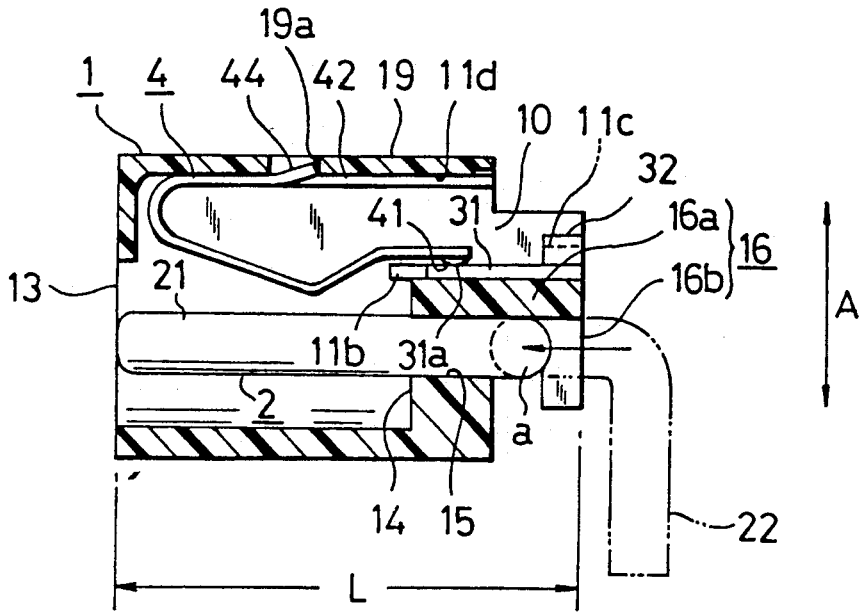
FIG. 2 is a section view of the power socket in FIG. 1.
Figure 3:
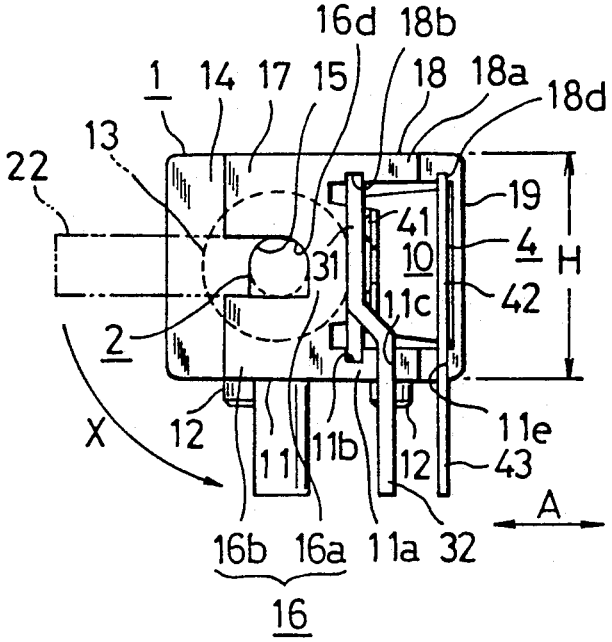
FIG. 3 is a back view of the power socket in FIG. 1.

In FIGS. 1 to 3, a housing 1 is a molded body made of an insulating resin and has an appearance of a rectangular parallelepiped and a hollow inside. The housing 1 has a bottom wall 11 adapted to come in contact with or to be opposite to a circuit board (not shown). The bottom wall 11 has projections 12 serving as positioning members with respect to the circuit board. The housing 1 is provided at the front end surface thereof with an opening 13 into and from which a plug is to be inserted and removed. The housing 1 is provided, at the rear end surface thereof at the position which is opposite to the opening 13, with a rear wall 14. The rear wall 14 has a circular pin insertion hole 15.

As clearly shown in FIG. 2, the rear wall 14 has an engagement fixing body 16 integrally formed therewith. The engagement fixing body 16 is made substantially in an L-shape by a support wall **16*a* and an engagement piece 16*b*. The support wall 16*a* rearwardly projects from the rear wall 14. Under the axis of the pin insertion hole 15, the engagement piece 16*b* projects transversely from the support wall 16*a*, i.e., in a direction A along the surface of a circuit board on which the power socket is to be mounted. A joint face 16*c* of the rear wall 14, the support wall 16*a* and the engagement piece 16*b*** has an arcuate face of which shape is identical with the shape of the peripheral face of a terminal portion 22 of a pin 2 to be discussed later.

Disposed above the axis of the pin insertion hole 15 is a projecting wall 17 which connects the upper end of the support wall 16*a* to the rear wall 14. A joint face 16*d* of the projecting wall 17 and the support wall 16*a* has an arcuate face of which shape is identical with that of a peripheral face of a plug connection portion 21 of the pin 2 and which is continued, without any difference in level, to a portion of the inner surface of the pin insertion hole 15. This projecting wall 17 reinforces the support wall 16*a* and the rear wall 14.

In the housing 1, the bottom wall 11 and an upper wall 18 have rearwardly projecting pieces 11*a*, 18*a*, respectively, which are opposite to each other. The projecting pieces 11*a*, 18*a* are respectively provided in the inner surfaces thereof with narrow grooves 11*b*, 18*b* which respectively reach the inner surfaces of the bottom wall 11 and the upper wall 18 of the housing 1. The projecting piece 11*a* of the bottom wall 11 further has a notch 11*c* adjacent to the narrow groove 11*b*. The projecting piece 11*a* of the bottom wall 11 extends to the support wall 16*a*, thereby to reinforce the engagement fixing body 16. The projecting piece 18*a* of the upper wall 18 extends to the projecting wall 17, thereby to reinforce the projecting wall 17 and the support wall 16*a*.

As shown in FIGS. 2 and 3, an opening 10 is formed between the rear wall 14 and a lateral wall 19 of the housing 1. The bottom wall 11 and the upper wall 18 are respectively provided with narrow grooves 11*d*, 18*d* in those portions of the inner faces thereof which come in contact with the lateral wall 19.

The pin 2 is made in an L-shape by the plug connection portion 21 and the terminal portion 22. The pin 2 is disposed as shown by virtual lines in FIGS. 2 and 3 in which, with the terminal portion 22 turned sideways, i.e., in the direction A above-mentioned, the plug connection portion 21 is pressingly inserted into the pin insertion hole 15 so that the terminal portion 22 is fitted between the engagement piece 16*b* and the projecting wall 17. Thereafter, the terminal portion 22 is rotated by 90° as shown by an arrow X in FIG. 3, so that the terminal portion 22 is held by and between the rear wall 14 and the engagement piece 16*b*. This causes the terminal portion 22 of the pin 2 to project toward a circuit board on which the power socket is to be mounted.

When the pin 2 is set in this way, the joint face 16*c* prevents the pin 2 to be reversely rotated. Further, the engagement piece 16*b* engaged with the rear portion of the terminal portion 22 prevents the pin 2 to be retreated (pulled out). In addition, since the plug connection portion 21 is pressingly inserted into the pin insertion portion, the pin 2 is securely fixed to the housing 1. This prevents the plug connection portion 21 to be retreated by a pushing force exerted at the time when the plug connection portion 21 is inserted into the plug.

A stationary contact piece 3 has a plate portion 31, a terminal portion 32 extending from the rear end of the plate portion 31, and an engagement pawl 33 at the upper end edge of the plate portion 31. The plate portion 31 is provided at a predetermined position thereof with a stationary contact 31*a*. The lower and upper ends of the plate portion 31 are respectively inserted into the narrow grooves 11*b*, 18*b* of the housing 1. Through the notch 11*c* of the housing 1, the terminal 32 projects toward a circuit board on which the power socket is to be mounted. Further, the engagement pawl 33 bites the groove face of the narrow groove 18*b*, so that the stationary contact piece 3 is secured to the housing 1. At this time, the plate portion 31 comes in surface contact with the support wall 16*a*.

A movable contact piece 4 is formed by molding a metallic piece substantially into an U-shape, which is machined as required. The metallic piece is provided at one end thereof with movable contacts 41 and at the other end thereof with a seat plate portion 42. The seat plate portion 42 has a terminal 43 which extends therefrom, and an engagement piece 44 which is cut and obliquely outwardly raised. In the movable contact piece 4, the lower and upper ends of the seat plate portion 42 are inserted into the narrow grooves 11*d*, 18*d* of the housing 1. Through a notch 11*e* formed in the bottom wall 11 of the housing 1, the terminal 43 projects toward a circuit board on which the power socket is to be mounted. The movable contacts 41 come in contact with the stationary contact 31*a* of the stationary contact piece 3 due to the resiliency of the movable contact piece 4. The movable contact piece 4 is secured to the housing 1 when the engagement piece 44 is engaged with a stepped portion 19*a* formed on the lateral wall 19 of the housing 1. At this time, the seat plate portion 42 comes in surface contact with the lateral wall 19.

When a plug (not shown) is inserted into the plug connection portion 21 through the opening 13, the plug causes the movable contact piece 4 to be displaced against the resiliency thereof. Accordingly, the movable contacts 41 are separated from the stationary contact 31*a*. On the contrary, when the plug (not shown) is pulled out from the plug connection portion 21, the movable contact piece 4 is restored by the resiliency thereof, so that the movable contacts 41 come in contact with the stationary contact 31*a*.

Figure 7:
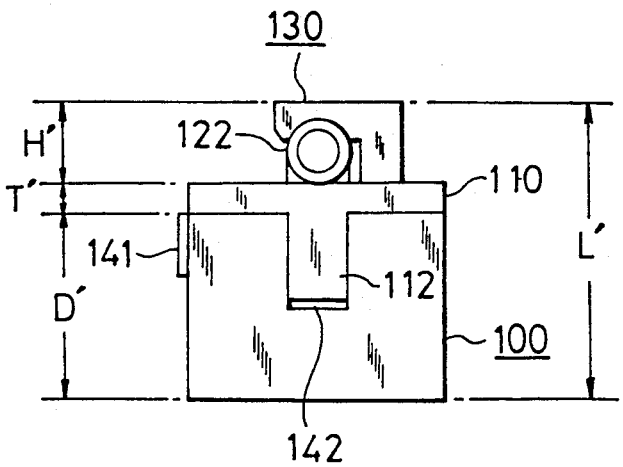
Fig.7 (Prior Art)
FIG. 7 is a bottom view of the power socket in FIG. 6.

In the power socket, the pin 2 and the stationary and movable contact piece 3, 4 are disposed in parallel in the direction A along the surface of the circuit board, as shown in FIGS. 2 and 3. Even though the terminal portion 22 is disposed, in the direction A, as overlapping the stationary contact piece 3 and movable contact piece 4, the terminal portion 22 does not come in contact with the stationary contact piece 3 and the movable contact piece 4. It is therefore not required to dispose the boundary corner portion a between the plug connection portion 21 and the terminal portion 22 of the pin 2 at positions rearward of the stationary contact piece 3 and the movable contact piece 4, as conventionally done as described in connection with FIG. 7. This accordingly shortens the length of the plug connection portion 21. The stationary contact piece 3 and the movable contact piece 4 are secured to the housing 1 by the fixing portions thereof such as the engagement pawl 33, the engagement piece 44 and the like. This eliminates the cover 110 which is inevitable, in the conventional socket, for securing the stationary and movable contact pieces to the housing 100. Accordingly, the entire depth L of the power socket in FIG. 2 is shorter than the entire depth L' in the conventional socket. Thus, the power socket of the present invention may be made in an extremely thin and compact design.

As shown in FIG. 2, the support wall 16*a* of the engagement fixing body 16 is reinforced as held by and between the base portion of the plug connection portion 21 of the pin 2 and the plate portion 31 of the stationary contact piece 3, and the seat plate portion 42 of the movable contact piece 4 comes in surface contact with the lateral wall 19 of the housing 1, so that the lateral wall 19 is reinforced. In this connection, even though the support wall 16*a* and the lateral wall 19 are made thin, the required strength may be readily assured. It is therefore possible to shorten the transverse width in such extent that these walls are reduced in thickness. Thus, the power socket may be further reduced in size.

Figure 4:
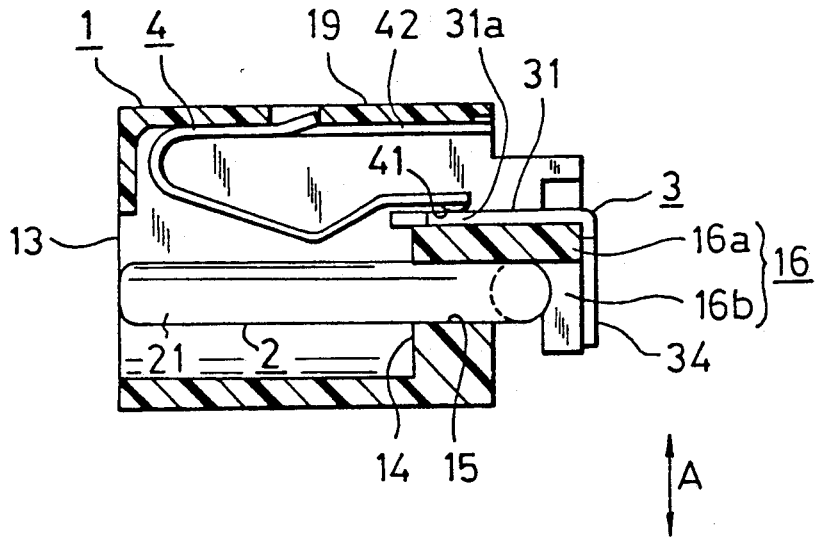
FIG. 4 is a view of a power socket in accordance with another embodiment of the present invention.
Figure 5:
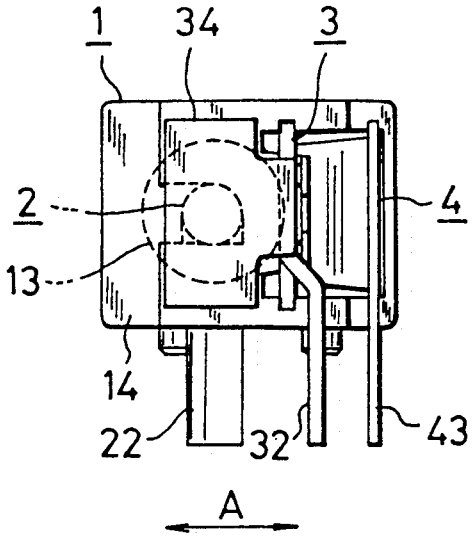
FIG. 5 is a back view of the power socket in FIG. 4.
Figure 6:
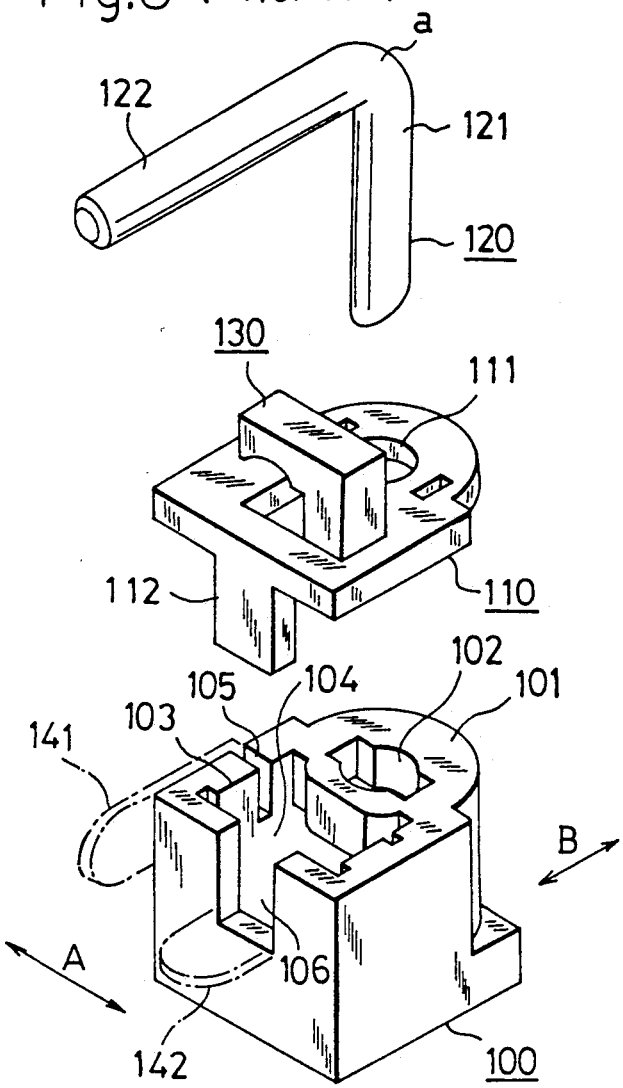
Fig.6 (Prior Art)
FIG. 6 is an exploded perspective view of a conventional power socket.

In a power socket shown in FIGS. 4 and 5, a plate-like portion 34 projects, as turning sideaways, from the rear end edge of the plate portion 31 of the stationary contact piece 3. This plate-like portion 34 supports the rear end surfaces of the projecting wall 17 and the engagement fixing body 16. According to this power socket, the engagement piece 16*b* of the engagement fixing body 16 is reinforced by the plate-like portion 34. Accordingly, even though the engagement piece 16*b* is thinned to further reduce the entire depth size L of the power socket, the arrangement above-mentioned securely prevents the plug connection portion 21 from being retreated while the engagement piece 16*b* is being bent backward, by a pushing force exerted at the time when a plug is inserted into the plug connection portion 21 of the pin 2.

The embodiment shown in FIGS. 4 and 5 is the same as the embodiment shown in FIGS. 1 to 3, except that the stationary contact piece 3 has the plate-like portion 34 in the embodiment in FIGS. 4 and 5. Accordingly, like parts are designated by like reference numerals used in FIGS. 1 to 3 and the detailed description thereof is here omitted.

What is claimed is:

1. A power socket comprising:

a housing;

an opening into and from which a plug is to be inserted and removed, said opening formed at the front end surface of said housing;

a rear wall having a pin insertion hole and formed at that position of the rear end surface of said housing which is opposite to said opening;

a pin having a plug connection portion and a terminal portion molded in an L-shape, said plug connection portion being inserted through said pin insertion hole into the hollow portion of said housing, said terminal portion extending along said rear wall and projecting toward a circuit board on which said power socket is to be mounted;

a stationary contact piece having (i) a plate portion having a stationary contact and (ii) a terminal which extends from said plate portion and which projects from said housing toward said circuit board, said stationary contact piece being disposed, with respect to said pin, in a direction along the surface of said circuit board;

a fixing portion formed at said stationary contact piece for securing said stationary contact piece to said housing;

a movable contact piece made of a metallic piece molded substantially in an U-shape, said movable contact piece being provided at one end thereof with movable contacts adapted to be separated from or come in contact with said stationary contact and at the other end thereof with a seat plate portion from which a terminal extends, said terminal projecting from said housing toward said circuit board, said movable contact piece being disposed, with respect to said pin, in said direction along the surface of said circuit board, said movable contact piece being adapted to be displaced by a plug inserted in or removed from said plug connection portion so that said movable contacts are separated from and come in contact with said stationary contact;

a fixing portion formed at said movable contact piece for securing said movable contact piece to said housing; and an engagement fixing body engaged with the rear portion of said terminal portion of said pin for securing said terminal portion to said housing, said engagement fixing body being formed on said rear wall.

2. A power socket according to claim 1, wherein:

the engagement fixing body has (i) a support wall rearwardly projecting from the rear wall and (ii) an engagement piece projecting from said support wall in the direction along the surface of the circuit board; and the terminal portion of the pin is held by and between said rear wall and said engagement piece.

3. A power socket according to claim 2, wherein the base portion of the plug connection portion of the pin comes in contact with the support wall of the engagement fixing body.

4. A power socket according to claim 2, wherein a pair of edges of the plate portion of the stationary contact piece are respectively inserted into grooves respectively formed in the bottom and upper walls of the housing, and said plate portion comes in surface contact with the support wall.

5. A power socket according to claim 3, wherein a pair of edges of the plate portion of the stationary contact piece are respectively inserted into grooves respectively formed in the bottom and upper walls of the housing, and said plate portion comes in surface contact with the support wall.

6. A power socket according to claim 1, wherein a pair of edges of the seat plate portion of the movable contact piece are respectively inserted into grooves respectively formed in the bottom wall and the upper wall, and said seat plate portion comes in surface contact with the inner surface of a lateral wall of the housing.

7. A power socket according to claim 2, wherein a pair of edges of the seat plate portion of the movable contact piece are respectively inserted into grooves respectively formed in the bottom wall and the upper wall, and said seat plate portion comes in surface contact with the inner surface of a lateral wall of the housing.

8. A power socket according to claim 5, wherein a pair of edges of the seat plate portion of the movable contact piece are respectively inserted into grooves respectively formed in the bottom wall and the upper wall, and said seat plate portion comes in surface contact with the inner surface of a lateral wall of the housing.

9. A power socket according to claim 1, wherein the plug connection portion of the pin is pressingly inserted into the pin insertion hole and projects into the inside of the housing.

10. A power socket according to claim 2, wherein the plug connection portion of the pin is pressingly inserted into the pin insertion hole and projects into the inside of the housing.

11. A power socket according to claim 8, wherein the plug connection portion of the pin is pressingly inserted into the pin insertion hole and projects into the inside of the housing.

12. A power socket according to claim 4, wherein the fixing portion formed on the stationary contact piece is an engagement pawl formed at the edge of the plate portion inserted into at least one of the bottom wall and the upper wall.

13. A power socket according to claim 5, wherein the fixing portion formed on the stationary contact piece is an engagement pawl formed at the edge of the plate portion inserted into at least one of the bottom wall and the upper wall.

14. A power socket according to claim 6, wherein the fixing portion formed on the movable contact piece is an engagement piece formed, as cut-raised, on the center of the seat plate portion.

15. A power socket according to claim 7, wherein the fixing portion formed on the movable contact piece is an engagement piece formed, as cut-raised, on the center of the seat plate portion.

16. A power socket according to claim 8, wherein the fixing portion formed on the stationary contact piece is an engagement pawl formed at the edge of the plate portion inserted into at least one of the bottom wall or the upper wall, and the fixing portion formed on the movable contact piece is an engagement piece formed, as cut-raised, on the center of the seat plate portion.

17. A power socket according to claim 16, wherein the plug connection portion of the pin is pressingly inserted into the pin insertion hole and projects into the inside of the housing.

18. A power socket according to claim 2, wherein the plate portion of the stationary contact piece is provided at the rear end edge thereof with a plate-like portion which comes in surface contact with the rear end surface of the engagement fixing body.

19. A power socket according to claim 5, wherein the plate portion of the stationary contact piece is provided at the rear end edge thereof with a plate-like portion which comes in surface contact with the rear end surface of the engagement fixing body.

20. A power socket according to claim 16, wherein the plate portion of the stationary contact piece is provided at the rear end edge thereof with a plate-like portion which comes in surface contact with the rear end surface of the engagement fixing body.

21. A power socket according to claim 20, wherein the plug connection portion of the pin is pressingly inserted into the pin insertion hole and projects into the inside of the housing.

* * * * *